United States Patent [19]

Glowacki

[11] Patent Number: 4,709,628

[45] Date of Patent: Dec. 1, 1987

[54] SCREW PRESS FOR DEWATERING SLUDGE AND FIBER SUSPENSIONS

[76] Inventor: Tad Glowacki, Nälstaplan 7, 162 24 Vällingby, Sweden

[21] Appl. No.: 860,234

[22] Filed: May 6, 1986

[30] Foreign Application Priority Data

May 10, 1985 [SE] Sweden ..... 8502339

[51] Int. Cl.[4] ..... B30B 9/18

[52] U.S. Cl. ..... 100/148; 100/117

[58] Field of Search ..... 100/148, 191, 147, 117, 100/45

[56] References Cited

U.S. PATENT DOCUMENTS

| | | | |
|---|---|---|---|
| 1,851,191 | 3/1932 | Lang | 100/148 X |
| 2,452,555 | 11/1948 | De La Roza | 100/191 X |
| 3,092,338 | 6/1963 | Reinhall | 100/117 X |
| 3,555,999 | 1/1971 | Glowacki | 100/148 |
| 4,520,724 | 6/1985 | Costarelli | 100/148 X |

FOREIGN PATENT DOCUMENTS

| | | | |
|---|---|---|---|
| 201823 | 2/1966 | Sweden | 100/148 |
| 7605402 | 8/1977 | Sweden . | |
| 1506455 | 4/1978 | United Kingdom | 100/148 |

*Primary Examiner*—Andrew M. Falik

*Attorney, Agent, or Firm*—Niles, Webner, Kurz & Bergert

[57] ABSTRACT

A screw press for dewatering sludge and fiber suspensions, having a feed screw, a perforated drum surrounding the feed screw, an inlet or infeed aperture at one end of the drum, and an end wall section at the other end forming an annular outlet or outfeed aperture. The end-wall section includes a plurality of flaps located as an extension of the feed screw, the flaps being yieldably arranged to adjust the size of the outlet aperture. The end of each flap nearest the axis (9) of the feed screw (1) is pivotally mounted on an attachment connection (11), and the attachment connection (11) is arranged for movement along the axis of the feed screw (1). The flaps (7) are arranged to be pressed outwards under the influence of a first force generating arrangement (15,17,18) to form a larger angle with the screw axis (9), thereby causing the outlet aperture to decrease in size. The attachment connection (11) is arranged so that it and the flaps connected thereto can be moved axially towards the outlet aperture (5) under the influence of a second force generating arrangement (20,21,22), to also decrease the size of the outlet aperture, the two force generating arrangements being adjustable independently of one another.

5 Claims, 4 Drawing Figures

SCREW PRESS FOR DEWATERING SLUDGE AND FIBER SUSPENSIONS

The present invention relates to a screw press for dewatering sludge and fiber suspensions.

BACKGROUND OF THE INVENTION

One such press is described, inter alia, in Swedish patent specification No. 7605402-2 and incorporates a feed screw, a perforated drum which surrounds the feed screw and which has an inlet or infeed aperture at one end thereof and an annular outlet or outfeed aperture at the other end thereof. The outlet aperture is formed between an opening in the end-wall part of the drum and a flow regulator mounted in the extension of the screw.

In screw press arrangements of this kind the incoming suspension is captured by the helix of the screw and advanced towards the annular outlet while being compressed. Compression of the material during its travel along the screw takes place due to the fact that the outlet aperture is relatively small; the water or other liquid pressed from the material departs through the perforations in the drum casing.

The residual water content of the dewatered pulp discharged through the outlet depends to a very large extent on the size of the outlet.

It is known to provide such screw presses with a variable outlet aperture, by using a flow regulator, normally of conical configuration, which is spring biassed in an axial direction, so that in the event of a plug of material forming in the outlet, the flow regulator will move axially away from the outlet, therewith automatically enlarging the outlet aperture and enabling the plug of material to pass therethrough, whereupon the pressure build-up is relieved and the pressure falls back to its normal level. The flow regulator is then returned to its original position in the outlet aperture, by the flow regulator spring.

An arrangement has also been proposed in which the drum with its end-wall section is sprung from movement in the axial direction, therewith providing a similar function to that of a spring-loaded flow regulator.

The arrangement described in the aforementioned Swedish Patent Specification No. 7605402-2 includes a plurality of slides which together regulate the size of the outlet aperture. Each slide can be displaced axially in a direction parallel with the axis of the infeed screw, and all slides together substantially cover the outlet aperture when occupying their respective closed positions.

Although a screw press constructed in accordance with this patent functions perfectly well, it has the drawback that adaptions must be made for each type of sludge or fiber suspension to be treated therein. This drawback, or problem, is inherent in all known screw presses.

For example, there are sludge or fiber suspensions in which the suspended material will exert low frictional forces against the perforated screening baskets, whereas the material of other suspensions will exert a high degree of friction against the screening baskets. In addition, the suspensions to be treated may have a consistency which requires a large outlet aperture, in order to avoid jamming between the screw and the surrounding drum casing, while suspensions of another consistency may require a small outlet aperture, so that sufficient water can be pressed from the suspension.

These problems are solved by the present invention.

SUMMARY OF THE INVENTION

The present invention relates to novel improvements in a screw press for dewatering sludge and fiber suspensions having a feed screw, a perforated drum surrounding the feed screw, an inlet aperture at one end of the drum, and an annular outlet aperture located at the other end of the drum and formed between the forward edge of the drum and an end-wall section. The end-wall section includes a plurality of yieldable flaps located as an extension of the screw, enabling the size of the outlet aperture to be adjusted through the ability of the flaps to yield. The novel improvements being that each of the flaps is pivotally mounted to attachment structure at the flap-end located nearest the screw axis. The attachment structure is arranged for movement along the screw axis. The flaps are arranged to be urged outwardly by a first force generating device or devices to form a larger angle with the screw axis, therewith to reduce the size of the outlet aperture; and that the aforesaid attachment structure is arranged to be moved axially by a second force generating device or devices towards the outlet aperture, so as to reduce the size of the aperture, the force generating devices being adjustable independently of one another.

The present invention is based on the concept of using a plurality of spring flaps which can be displaced axially towards and away from the outlet aperture in order to vary the size of said aperture. By incorporating these two control facilities it is possible to set the press for use with all occurring sludge and fiber suspension.

The invention will now be described in more detail with reference to an exemplifying embodiment thereof illustrated in the accompanying drawing, in which

DESCRIPTION OF THE PREFERRED EMBODIMENTS

Figure 1:
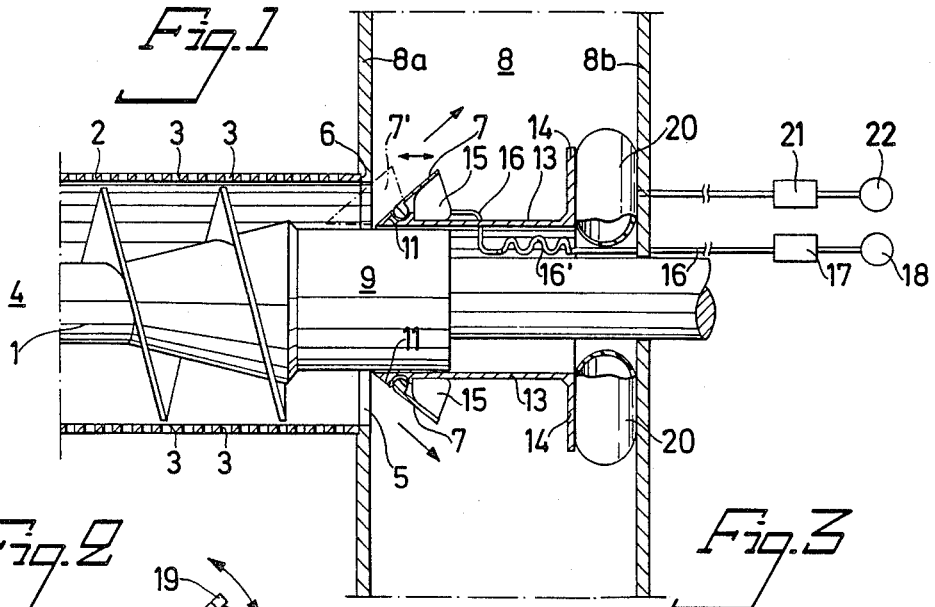
FIG. 1 is an axial sectional view of part of a screw press according to the invention.

FIG. 1 illustrates a screw press for dewatering sludge and fiber suspensions. The screw press includes a feed screw 1, a drum 2 which surrounds the screw 1 and which is perforated with holes 3, an inlet aperture 4 at one end of the drum, an annular outlet aperture 5 at the other end of the drum. The outlet aperture is formed between the forward edge 6 of the drum and an end-wall section thereof. The end-wall section of the drum comprises a plurality of flaps 7 located in the extension of the infeed screw. The flaps 7 are yieldable in a manner hereinafter described, so as to enable adjustments to be made to the size of the outlet aperture 5. The forward edge 6 of the drum merges with a transport tunnel 8, the walls 8*a*, 8*b* of which extend at right angles to the longitudinal axis (axle) of the drum 2.

Figure 2:
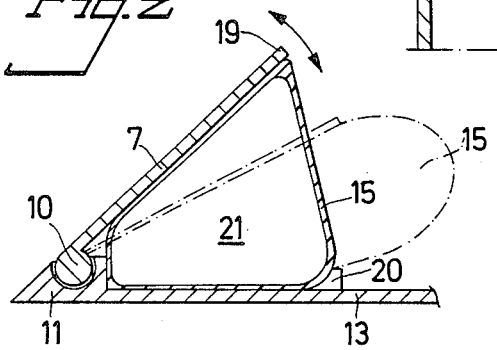
FIG. 2 illustrates a flap in larger scale than that of FIG. 1.

Each of the flaps 7, of which one is shown in larger scale in FIG. 2, is pivotally mounted at the end thereof located nearest the axis (axle) 9 of the screw 1 on a journal or pivot 10 located on an attachment means 11.

Figure 4:
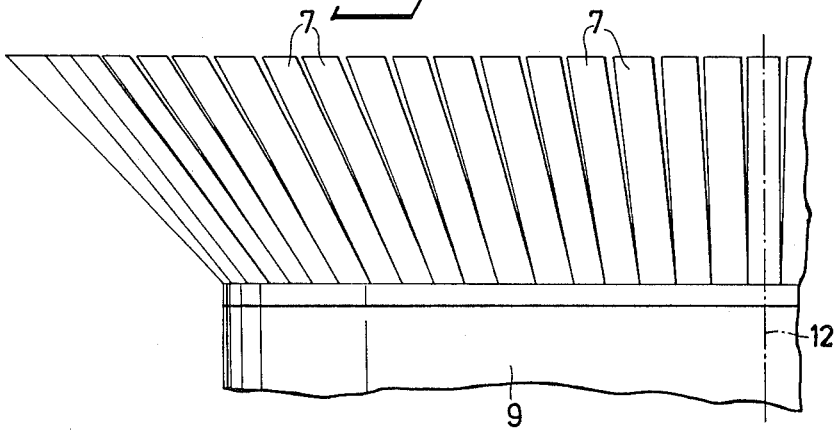
FIG. 4 is a detail view of mutually adjacent flaps, seen in plan in FIG. 1 and drawn to a larger scale than that of FIG. 1.

There may be a large number of the flaps 7, as illustrated in FIG. 4, in which the flaps 7 are shown from above in FIG. 1 and in which the center line 12 marks a symmetrical vertical plane through the feed screw illustrated in FIG. 1. Thus, in FIG. 4 the flaps are seen in a quadrant in the annular outlet aperture. The flaps are arranged to be urged outwardly under the influence of a first force generating means, so as to form a larger angle with the screw axis 9, and therewith reduce the size of the outlet aperture.

The attachment means 11 includes a cylindrical drum 13, which is concentrical with the screw axis 9 and which is provided with a radially and outwardly projecting flange 14 on its rearward end. This flange 14 is acted upon by a second force generating means. The force generated by this second means is effective in moving the attachment means 11 axially towards the outlet aperture 5, such as to displace the flaps towards the forward edge 6 of the drum 2 and therewith reduce the size of the outlet aperture.

Thus, in addition to the flaps being pivotable about the pivot 10, the flap attachment means can be moved, and therewith also the flaps, towards and away from the inlet aperture.

In accordance with one embodiment the attachment means, including the cylinder 13 and the flange 14, is common to all flaps.

In accordance with one preferred embodiment, the aforementioned first force generating means comprises a bellows-like device 15 or like device made of an elastic material, such as rubber, and extending around the drum 13 of the attachment means and beneath each flap 7, the bellows-like device 15 or like means being connected to a controllable pressure source 17,18 through a pipe means 16. The pipemeans 16 incorporates an extensible part 16' which permits the attachment means 11 and therewith the flaps 7 to be moved from the position shown in full lines in FIG. 1 to the position 7' shown in chain lines therein, this position corresponding to the foremost position of displacement of the attachment means 11.

Instead of bellows-like device in the form of a hose 15, an elastic wall my be attached between the free end 19 of the flap and a shoulder 20 on the cylindrical drum 13 of the attachment means, so as to form an airtight chamber 21.

The invention also embraces an embodiment in which each flap 7 is connected to an individual bellows-like device with individual adjustment possibilities, and also an embodiment in which there is provided a bellows-like device 15 which is common to all flaps 7.

The pressure source preferably comprises an air pump 18 and a control valve 17. When the pulp is pressed against the flaps by the screw 1, the flaps are pressed downwards, as indicated in chain lines in FIG. 2, until the air pressure in the bellows-like device 15 balances the force exerted by the pulp on the flaps 7.

As beforementioned, the attachment means 11 can also be displaced towards the outlet aperture 5. This is effected with the aid of the said second force generating means, (20,23) which in accordance with one preferred embodiment (as shown in FIG. 1) includes a bellows-like device 20 in the form of a hose made of an elastic material, such as rubber, which is placed between the flange 14 and the rear wall **8*b* of the transport tunnel 8 or some other counter-pressure surface. The bellows-like device 20 is connected to a pressure source, preferably in the form of a controllable or adjustable pressure source 21,22. The pressure source may conveniently have the form of an air pump 22 and a control valve 17**.

It will be understood that the maximum pressure required of the bellows-like devices will depend on the size of the screw press and the size of the flaps, etc, although it can be said in general that a maximum pressure of 10 atm will suffice.

Figure 3:
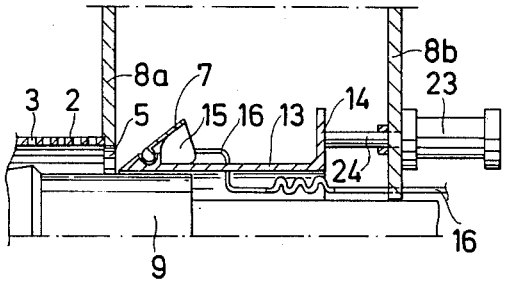
FIG. 3 illustrates an embodiment different to that of FIG. 1, with respect to a force generating means for displacing the flaps axially.

FIG. 3 illustrates a further embodiment which incorporates pressure piston-cylinder devices 23 externally of the rear wall **8*b* of the transport tunnel 8, of which piston-cylinder devices only one has been shown in the Figure. The piston 24 of respective piston-cylinder devices 23 act against the flange 14 in a manner to displace the support 13 in a direction towards the outlet aperture 5. It will be noticed that FIG. 3 shows only a part of the arrangement illustrated in FIG. 1. In this further embodiment of the invention, there may be used three piston-cylinder devices 23 arranged symmetrically in relation to the circular flange, when seen from the right in FIG. 1, i.e. with a peripheral angle of 120° between each cylinder. The piston-cylinder devices are preferably pneumatic devices driven via an air pump 22 and a control valve 21**.

Irrespective of which of the two latter embodiments are used, it will be obvious that the force required to maintain one or more flaps in an upwardly swung or lifted position, or the force required to displace a respective attachment means towards the outlet aperture when pulp is advanced by the screw can be adjusted individually. This possibility of making individual adjustments is important.

The invention also includes the case in which each flap 7 has an individual attachment means 11 which can be individually displaced axially towards the outlet aperture. Such an arrangement, however, is not preferable to the arrangement in which a single attachment means 11 is common to all flaps 7.

Thus, the problem discussed in the introduction is solved by the present invention, which firstly enables the initial size of the outlet aperture 5 to be adjusted with the aid of the said second force generating means, which determines the axial position of the attachment means 11, and secondly enables the size of the outlet aperture peripherally around the outlet aperture to be varied as desired with the aid of the first force generating means, which determines the force which the advancing pulp must exert in order to fold down one or more flaps 7.

As will be understood, the extent to which the flaps are pushed down during operation, and the axial position of the attachment means will vary due to the fact that the pulp advances against the pressure set in the two force generating means.

These pressures are readily set by means of the control valves 17,21, and hence a suitable adjustment can be made at the beginning of the dewatering process for each sludge or fiber suspension.

By way of a schematic example it can be mentioned that the force exerted by the bellows-like device 20 for the attachment means 11 on the outflowing pulps shall be greater than the force exerted on the pulp by the bellows-like device 15 co-acting with the flaps when, inter alia, dewatering pulps which exhibit low friction against the perforated screening drum 2, and, inter alia, pulps which in order to be dewatered satisfactorily require a small outlet aperture.

The reverse force relationship can be applied, inter alia, when dewatering pulps which require a large outlet aperture in order to prevent the pulps from jamming between the feed screw and the outlet aperture. This generally applies to coarse pulps.

It will readily be understood that in addition to providing a wide range of adjustment possibilities the present invention also provides a screw press of simple and operationally reliable construction.

The present invention is not restricted to the aforedescribed embodiments and that modifications can be made within the scope of the following claims.

I claim:

1. A screw press for dewatering sludge and fiber suspensions, comprising: a feed screw having an axis, a perforated drum surrounding the feed screw, an inlet aperture at one end of the drum and an annular outlet aperture located at the other end of the drum which includes a forward peripheral edge; said feed screw having an axial extension projecting through and coaxial with said other end of said drum, and an end-wall section of said annular outlet aperture comprising a plurality of flaps mounted coaxially relative to the extension of the feed screw, so that said flaps are yieldably arranged in a manner to enable the size of the outlet aperture to be adjusted, characterized in that: an attachment means (11) is provided, the end of each flap (7) located nearest the axis (9) of the feed screw (1) is pivotally mounted to said attachment means (11), and said attachment means (11) is arranged for displacement along the axis of the feed screw (1); a first force generating means mounted in structural association with said flaps, the flaps (7) being arranged to be pressed outwardly under the influence of said first force generating means (15,17,18) to form a larger angle with the screw axis (9), therewith to decrease the size of said outlet aperture (5); a second force generating means (20,21,22) in structural association with and enabling said attachment means (11) to be pressed axially towards the outlet aperture (5) under the influence of said second force generating means (20,21,22) thereby to decrease the size of said outlet aperture; and in that said first and said second force generating means can be adjusted independently of one another.

2. A screw press according to claim 1, characterized in that the attachment means (11) is common to all flaps (7).

3. A screw press according to claim 2, characterized in that an end of the attachment means (11) remote from the outlet aperture (5) has provided thereon a radially and outwardly projecting flange (14) which extends around the screw axis (9) at a radial distance therefrom; and in that the second force generating means (20,21,22) is arranged to cause the flange (14) to be moved towards the outlet end, thereby to press the flaps (7) against the outflowing dewatered sludge and fiber material.

4. A screw press according to claim 3, characterized by an elastic bellows-like device (20) which is arranged between the flange (14) and a wall **(8*b*) which is stationary relative to said other end of said drum, and which device extends around the screw axis (9) but at a radial distance therefrom, said bellows-like device being connected to a controllable pressure source (21,22)** preferably an air-pressure source.

5. A screw press according to claim 1, characterized by said first force generating means being in the form of a first bellows-like device (15) made of an elastic material and arranged between each flap (7) and a cylindrical drum (13) associated with the attachment means (11), said bellows-like device being connected to a controllable pressure source (17,18), preferably an air-pressure source.

* * * * *